US011027895B1

(12) United States Patent
Vossen-Henslin et al.

(10) Patent No.: US 11,027,895 B1
(45) Date of Patent: Jun. 8, 2021

(54) DEVICE FOR EXTRACTING RESIDUAL AMOUNTS OF FLUID FROM A CONTAINER

(71) Applicants: Julie Beth Vossen-Henslin, Willmar, MN (US); Steven T. Vossen, Willmar, MN (US)

(72) Inventors: Julie Beth Vossen-Henslin, Willmar, MN (US); Steven T. Vossen, Willmar, MN (US)

( * ) Notice: Subject to any disclaimer, the term of this patent is extended or adjusted under 35 U.S.C. 154(b) by 0 days.

(21) Appl. No.: 16/705,387

(22) Filed: Dec. 6, 2019

Related U.S. Application Data

(60) Provisional application No. 62/776,133, filed on Dec. 6, 2018.

(51) Int. Cl.
*B65D 47/08* (2006.01)
*B65D 51/24* (2006.01)

(52) U.S. Cl.
CPC ..... *B65D 47/0804* (2013.01); *B65D 51/249* (2013.01)

(58) Field of Classification Search
CPC ..... B65D 47/0804; B65D 51/249
See application file for complete search history.

(56) References Cited

U.S. PATENT DOCUMENTS

2008/0029559 A1* 2/2008 Selina ..... B44D 3/127 222/570
2016/0297583 A1* 10/2016 Staeben ..... B65D 47/0804
2018/0162607 A1* 6/2018 Rivera ..... B65D 81/3446
2018/0257831 A1* 9/2018 Benoit-Gonin .... B65D 47/0838
2019/0300243 A1* 10/2019 Lewis ..... B65D 35/44
2020/0231347 A1* 7/2020 Huang ..... B65D 43/162

* cited by examiner

*Primary Examiner* — Donnell A Long
(74) *Attorney, Agent, or Firm* — Jeffrey C. Brown PLLC; Jeffrey C. Brown

(57) ABSTRACT

A device for extracting residual amounts of fluid from containers, including containers for consumer products is disclosed. The device comprises a lid, further comprising a plug; a flexible hinge; and a threadless cap, further comprising an opening, a notch, and a tapered, flexible neck. Another embodiment of the device includes material wherein the lid is comprised of a material more rigid than the tapered, flexible neck. A further embodiment of the device includes material wherein the cap is comprised of material more rigid than the tapered, flexible neck.

3 Claims, 9 Drawing Sheets

DEVICE FOR EXTRACTING RESIDUAL AMOUNTS OF FLUID FROM A CONTAINER

BACKGROUND OF THE INVENTION

1. Field of the Invention

The present invention relates to a device for extracting residual amounts of fluid from containers, including containers for consumer products.

2. Background

Consumers and other persons purchase a myriad of products that come in fluid form, like soaps, shampoos, lotions, condiments, and similar items. Often, such products are packaged and sold in plastic and other containers. When such containers are at or near full capacity, it is relatively easy for the user to extract the fluid from the container. But as the fluid in the container is depleted, small amounts of fluid often remain, and such residual amounts are difficult to extract. To solve this problem, some manufacturers have adapted their containers so they may be turned upside down to allow gravity to pull the fluid from the bottom of the container to near the top of the container, so the user can extract more of the fluid from the container. Not all manufacturers, however, have modified their containers in such a way. In such cases, the user must devise other means to extract the last bit of fluid from the container, which are often awkward and messy.

3. Description of the Prior Art

As stated earlier, some manufacturers of products containing lotions, shampoos, condiments and the like, have adapted their bottle tops so the container can rest upside down to allow gravity to pull the fluid from the bottom of the container to near the top of the container. Other art, like that disclosed in U.S. D724,943 to Epstein, shows a screw-on fitment that may replace a standard bottle top to allow the container to rest upside down.

Other devices, like the Fluid Recovery Cap System disclosed in U.S. Pat. No. 6,418,987 to Colasacco, provides a dual cap that allows a user to stack one container on top of another to allow gravity to empty the top container into the lower container. As disclosed in the Colasacco patent, the containers are connected to the dual cap by threading both containers on opposite sides of the device. While such a device may assist in fully emptying the container on top, it may not be easily deployed to empty the second container when the fluid volume therein becomes low.

Thus, there is a need for a device that is reusable and adaptable to various bottle top sizes while providing a stable base when the container is turned upside down to assist in extracting residual fluid from the container.

BRIEF SUMMARY OF THE INVENTION

The device disclosed herein is designed to facilitate extracting residual amounts of fluid products from a container. Such products include, but are not limited to, soaps, shampoos, lotions, condiments and the like. Condiments suitable for use with the device may include fluid food products like ketchup, mustard, and other food products whose container has not been adapted to be stably inverted to allow gravity to pull residual amounts of the product from the bottom of the container to near the top.

The device disclosed herein is so designed that it may be adapted to various bottle top sizes while providing a stable base when the container is inverted. The device is further adapted to be reusable. By using the device disclosed herein, users can save money by being able to access and use residual amounts of fluid products and thereby minimize waste.

DESCRIPTION OF THE DRAWINGS

The invention can be better understood by reference to the following drawings, wherein.

DETAILED DESCRIPTION

In the following detailed description, reference is made to the accompanying drawings that form a part hereof, and in which are shown by way of illustration specific embodiments or examples. These embodiments may be combined, other embodiments may be utilized, and structural, logical, and procedural changes may be made without departing from the spirit and scope of the present invention. The following detailed description is, therefore, not to be taken in a limiting sense, and the scope of the present invention is defined by the appended claims and their equivalents.

Figure 1:
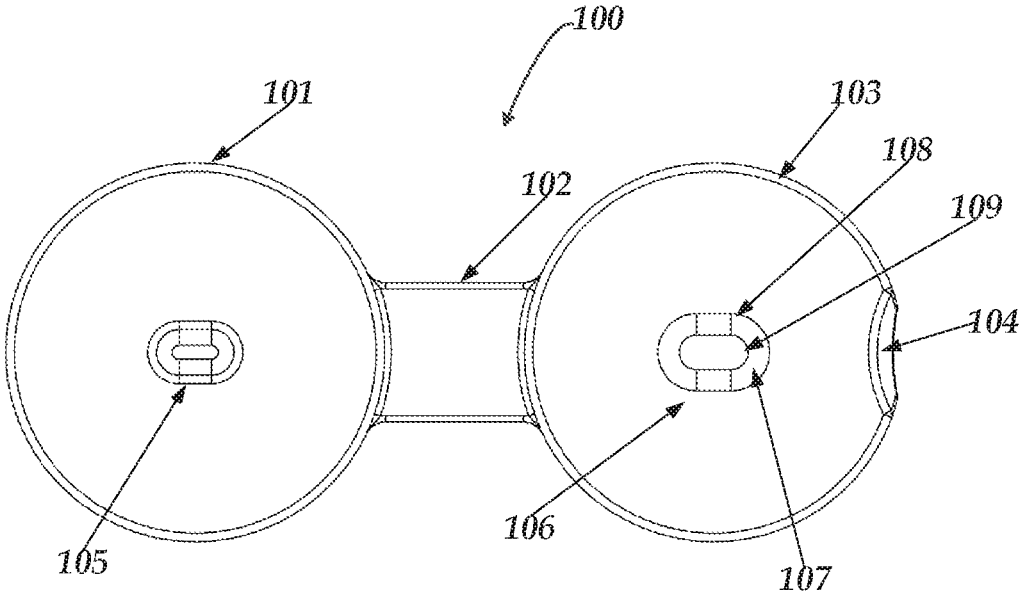
FIG. 1 shows a top view of an embodiment of a device for extracting residual amounts of fluid from a container.

As disclosed in FIG. 1, an embodiment of a device 100 for extracting residual amounts of fluid from a container includes a lid 101 that also serves as a base for the container when it is inverted, and a hinge 102 connecting the lid to a threadless cap 103. The lid 101 further includes a plug 105 adapted to be secured within an opening 106 in the cap 103. In one embodiment as shown in FIG. 1, the opening 106 resembles an oblong shape with concave sides 107 wherein the circumference of the posterior end of the opening 108, namely the end proximate the lid 101, is greater than the circumference of the anterior end of the opening 109, namely the end distal the lid 101. When the opening 106 is configured in this fashion, it facilitates drainage of the fluid back into the container when the container is in the upright position. When the plug 105 is secured within the opening 106, the plug 105 serves to minimize evaporation of the fluid when the container is upright and also prevents the fluid from leaking from the container when it is inverted. FIG. 1 also discloses a notch 104 that allows the lid 101 to be easily detached from the cap 103 when a user wants to extract the fluid from the container.

Figure 2:
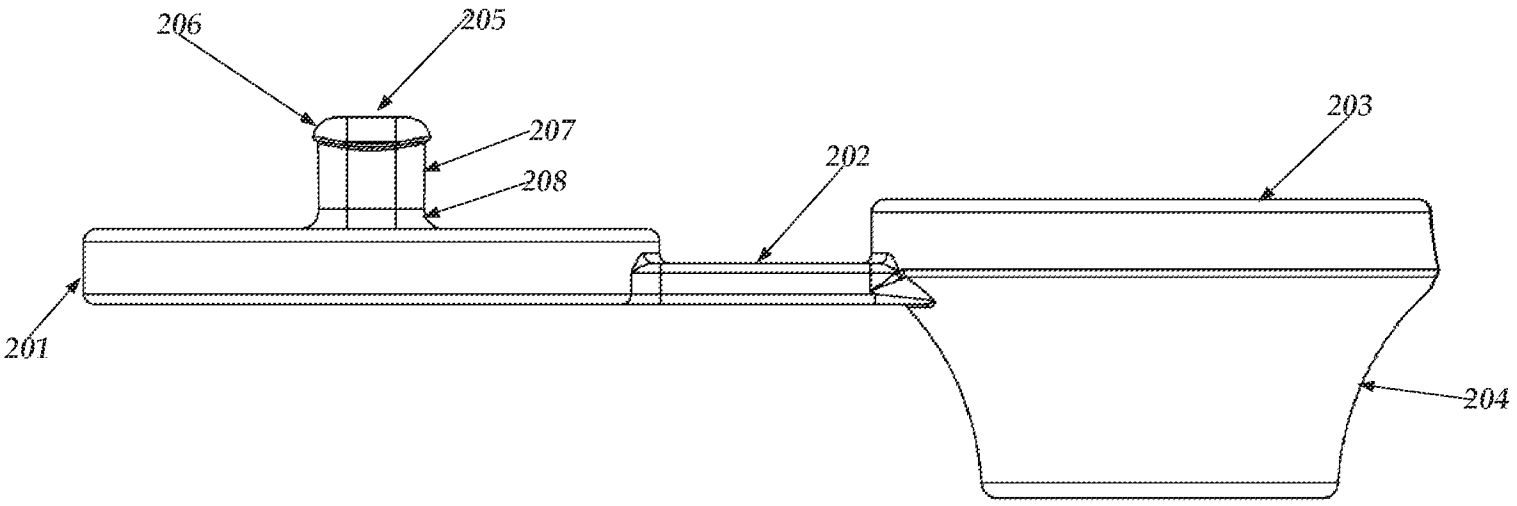
FIG. 2 shows a side view of an embodiment of a device for extracting residual amounts of fluid from a container.

FIG. 2 is a side view of an embodiment of a device 100 for extracting residual amounts of fluid from a container that shows the lid 201 attached to the cap 203 via the flexible hinge 202. FIG. 2 also shows a side view of the plug 205. In an embodiment as shown in FIG. 2, the plug 205 includes a distal end knob 206, which is the end configured to mate with the opening 105, a middle section 207, and an end 208 proximate the lid 201. When an embodiment of the plug 205 is configured in the fashion shown in FIG. 2, the distal end 206 includes a circumference that is generally larger than the middle section 207 to form a knob 206. The larger circumference of the knob 206 allows the plug 205 to securely and snuggly mate with the opening 106, which serves to minimize or prevent evaporation and leakage of fluid from the container and force any residual fluid retained in opening 105 back into the container when the plug 205 is engaged with the opening 105. FIG. 2 further shows a tapered neck 204 of the cap 203. The tapered neck design 204 is adapted to be flexible to accommodate and snugly fit a range of bottleneck sizes.

Figure 3:
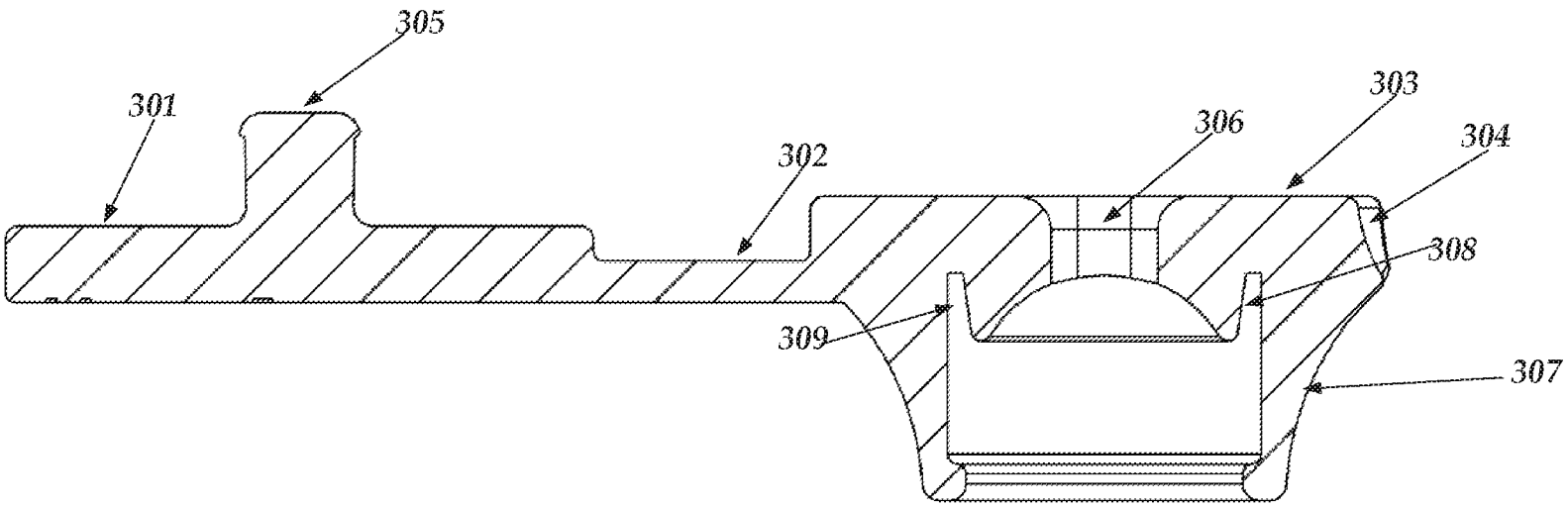
FIG. 3 shows a cut-away view of an embodiment of a device for extracting residual amounts of fluid from a container.

FIG. 3 is a cutaway view of an embodiment of a device 100 for extracting residual amounts of fluid from a container, which again shows a lid 301 connected to a cap 303 via a flexible hinge 302. FIG. 3 also shows an opening or conduit 306 through which a user can extract the fluid in the container after the user disengages the lid 301 from the cap 303 by using finger pressure on the lid via the notch 304. FIG. 3 further shows the tapered, flexible neck 307. FIG. 3 further shows an embodiment that includes a circumferential groove 308. In this embodiment, when the device is mated with a container, the circumferential groove 308 is adapted to engage the lip of the container to secure the device to the container and minimize or prevent fluid from leaking from the container while in the inverted position and resting on the device.

Figure 4:
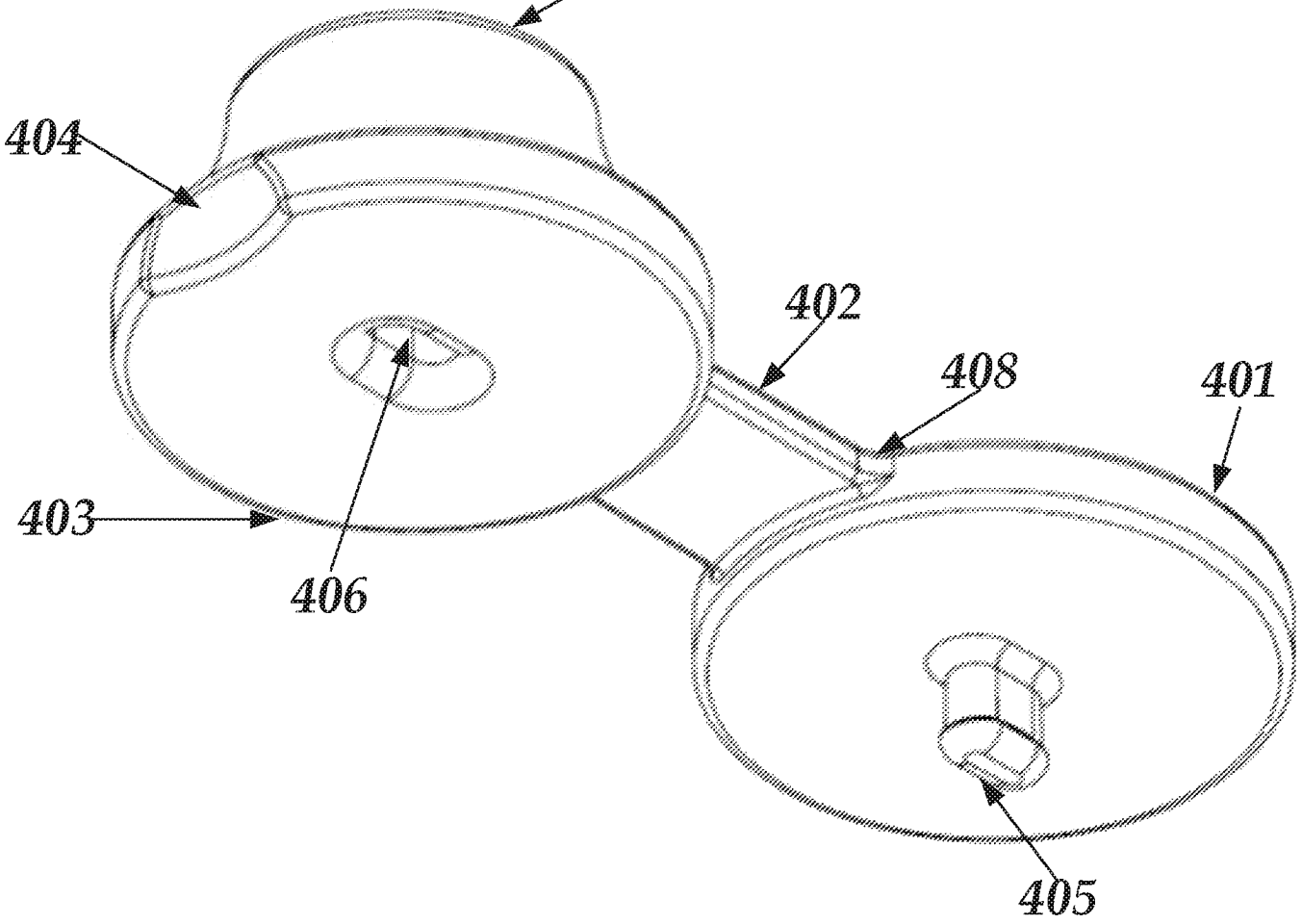
FIG. 4 shows a perspective view of an embodiment of a device for extracting residual amounts of fluid from a container.

FIG. 4 is a perspective view of an embodiment of a device 100 for extracting residual amounts of fluid from a container showing a lid 401 connected to a cap 403 via a flexible hinge 402. FIG. 4 also shows the plug 405, which is adapted to securely fit within the opening 406, and in which said plug 405 can be easily and quickly disengaged from the opening 406 by using finger pressure on the lid via the notch 404. FIG. 4 further shows the tapered, flexible neck 407 that is adapted to accommodate a variety of bottleneck sizes. FIG. 4 also may include an embodiment of the flexible hinge 402 that tapers outward 408 with a larger width where it attaches to the lid 401 and cap 403.

Figure 5:
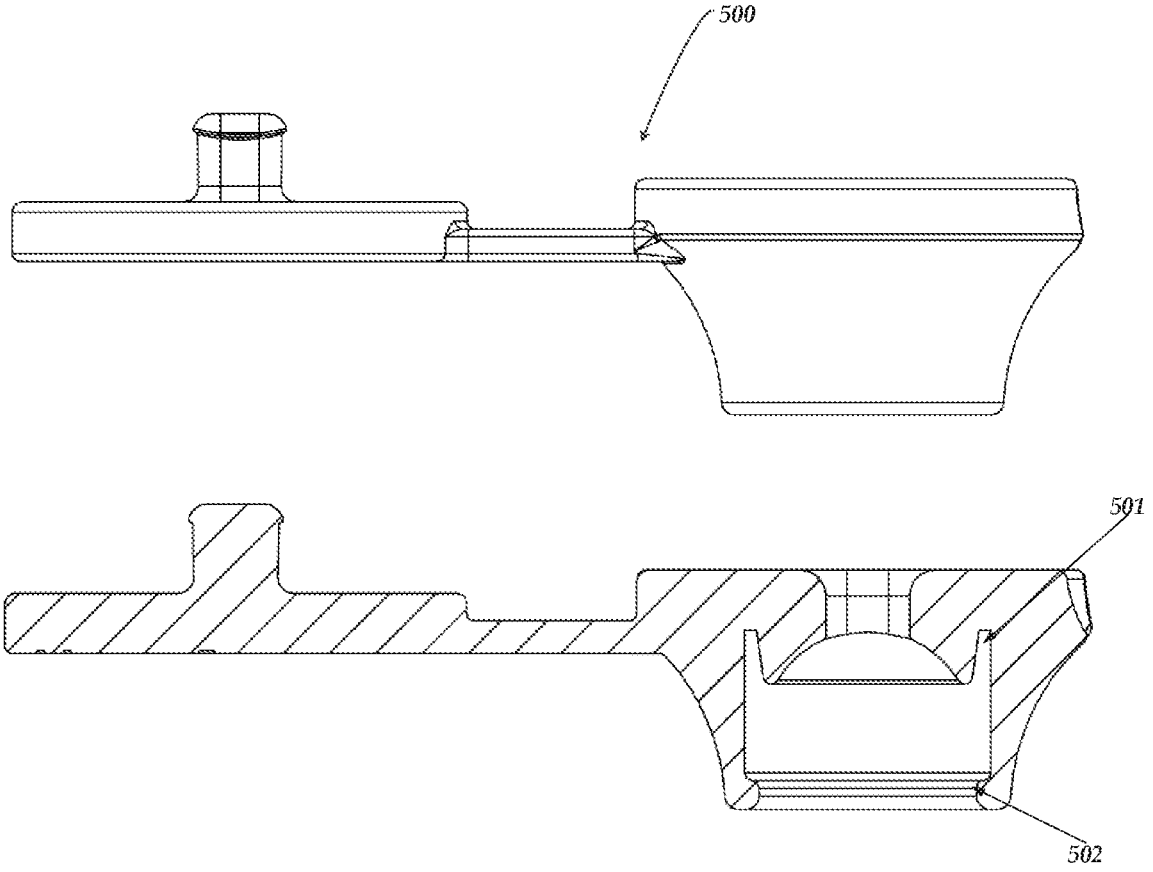
FIG. 5-9 show embodiments of a device for extracting residual amounts of fluid from a container.
Figure 6:
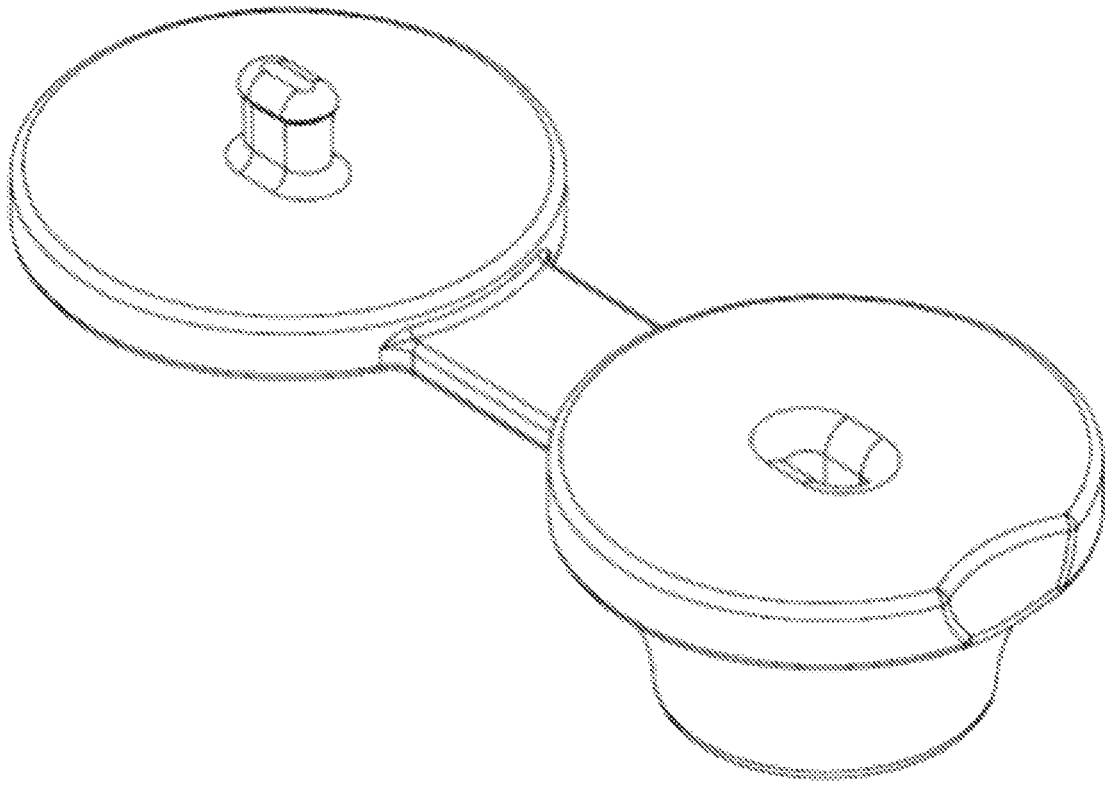
Figure 7:
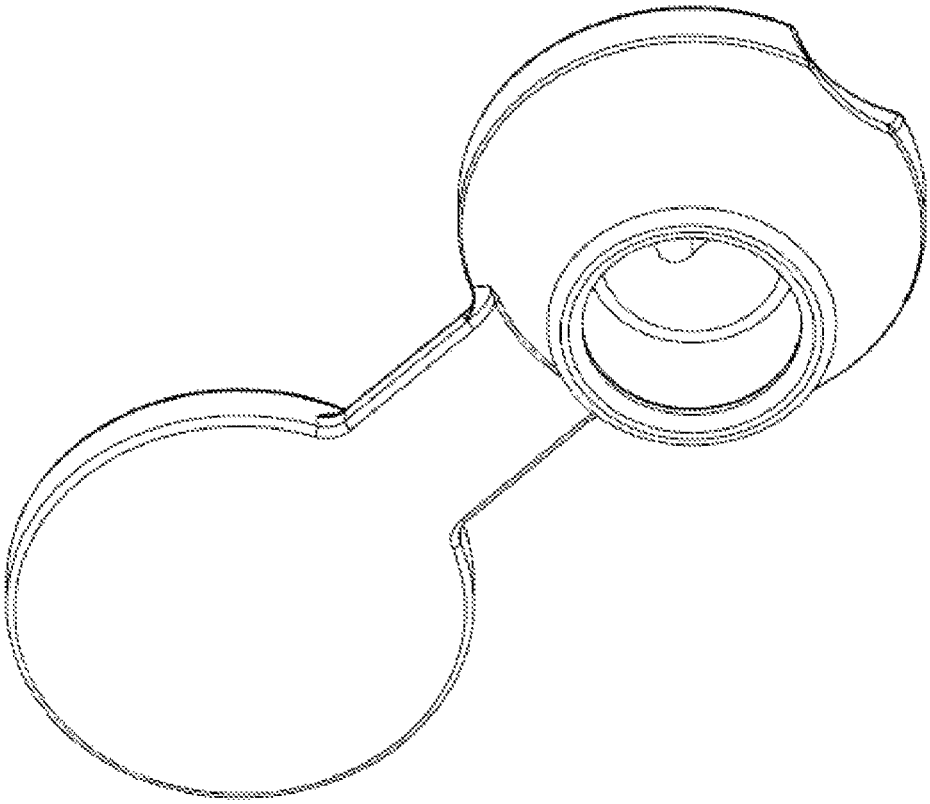
Figure 8:
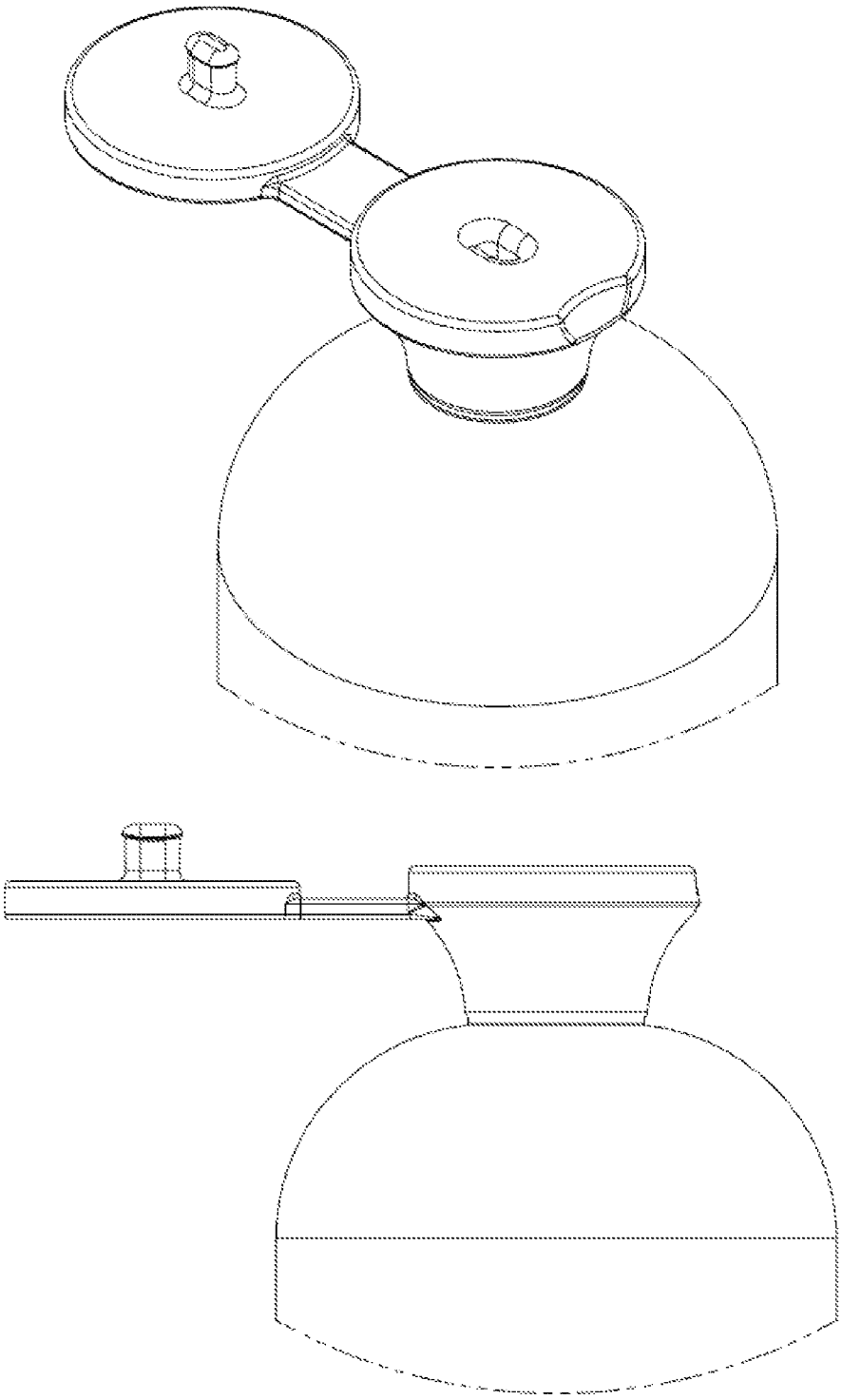
Figure 9:
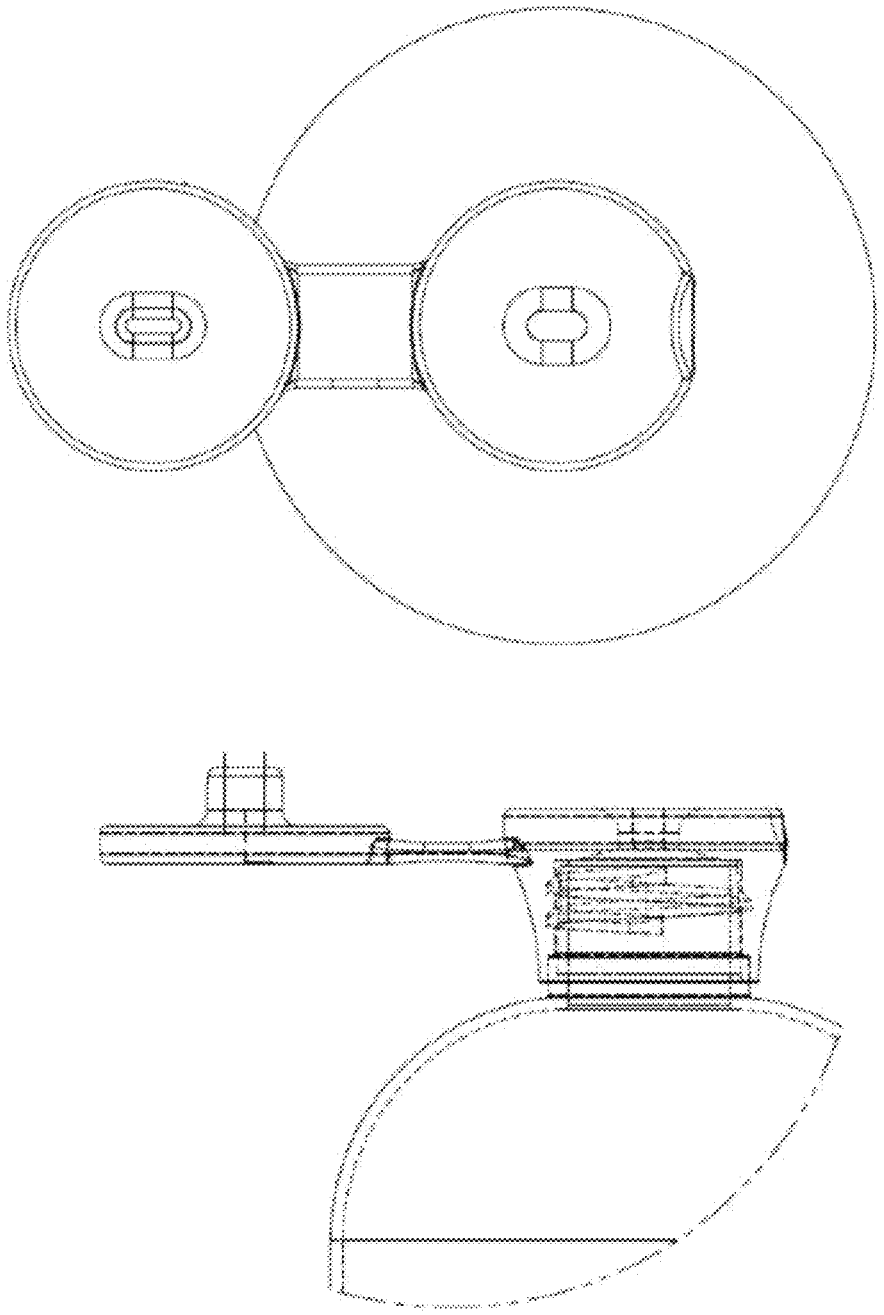

FIG. 5 shows an embodiment of a device 500 for extracting residual amounts of fluid from a container showing a tapered, circumferential groove or channel 501 adapted to engage the lip of the container to secure the device to the container and minimize or prevent fluid from leaking from the container while in the inverted position and resting on the device. FIG. 5 further illustrates a circumferential sealing lip 502 that is pliably adapted to compressively and securely fit a variety of bottleneck or container sizes. FIGS. 6-9 show embodiments of a device for extracting residual amounts of fluid from a container.

It is to be understood that the above description is intended to be illustrative and not restrictive. For example, the above-described embodiments and variations may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A device for extracting residual amounts of fluid from a container, including a container for a consumer product comprising:
   a. threadless cap, further comprising an opening, a notch, and a tapered, flexible neck, wherein the portion of the cap distal to the tapered, flexible neck is comprised of material more rigid than the tapered, flexible neck to provide a stable base when the container is inverted;
   b. a lid, wherein the lid is comprised of material more rigid than the tapered, flexible neck to provide a stable base when the container is inverted and further comprising a plug; and
   c. a flexible hinge.

2. A device for extracting residual amounts of fluid from a container, including a container for a consumer product comprising:
   a. a lid, further comprising a plug, wherein said plug includes a distal end knob, a middle section, and a proximate end, and wherein the distal end knob further includes a circumference that is generally larger than the middle section and wherein the lid is comprised of material more rigid than the tapered, flexible neck to provide a stable base when the container is inverted;
   b. a flexible hinge that tapers outward where it attaches to the lid and cap; and
   c. a threadless cap, further comprising an opening, a notch, and a tapered, flexible neck, wherein the opening resembles an oblong shape with concave sides and wherein the circumference of the posterior end of the opening is greater than the circumference of the anterior end of the opening and wherein the portion of the cap distal to the tapered, flexible neck is comprised of material more rigid than the tapered, flexible neck to provide a stable base when the container is inverted.

3. The device of claim 2, wherein the cap includes:
   a. a tapered, circumferential groove or channel adapted to engage the lip of the container to secure the device to the container and minimize or prevent fluid from leaking from the container while in the inverted position and resting on the device; and
   b. a circumferential sealing lip that is pliably adapted to compressively and securely fit a variety of bottleneck or container sizes.

* * * * *